United States Patent [19]

Hereford et al.

[11] 4,050,854

[45] Sept. 27, 1977

[54] FLUID LIFTING APPARATUS

[76] Inventors: Judson A. Hereford, 5827 Vena Drive, Houston, Tex. 77087; Franklin Beard, 14906 Cindywood, Houston, Tex. 77079

[21] Appl. No.: 729,857

[22] Filed: Oct. 4, 1976

[51] Int. Cl.[2] ..... F04F 1/08; F04F 1/12

[52] U.S. Cl. ..... 417/121; 417/126

[58] Field of Search ..... 417/118, 121, 122, 147, 417/125, 126, 128

[56] References Cited

U.S. PATENT DOCUMENTS

| | | | |
|---|---|---|---|
| 1,356,684 | 10/1920 | Aikman | 417/128 X |
| 1,741,115 | 12/1929 | Parrish | 417/147 X |
| 1,960,448 | 5/1934 | Meyer | 417/121 |
| 2,849,963 | 9/1958 | Duby | 417/126 X |

FOREIGN PATENT DOCUMENTS

| | | | |
|---|---|---|---|
| 572,642 | 3/1959 | Canada | 417/122 |
| 713,362 | 8/1931 | France | 417/125 |

*Primary Examiner*—William L. Freeh
*Assistant Examiner*—R. E. Gluck
*Attorney, Agent, or Firm*—Frank S. Vaden, III; Wayne M. Harding

[57] ABSTRACT

A fluid lifting apparatus operable by air pressure applied alternately to first and second pairs of cylinders each of said cylinders having a main body part, a barrel and a bottom chamber in communications with a bottom inlet. Pressuring of the main body part of the chamber, closes a check valve at the inlet and forces fluid from the main body part, through a fluid flow valve, through the chamber and up the barrel to a production tubing segment and hence to the next higher cylinder. Emptying of the main chamber closes the fluid flow valve to prevent air from the production tubing. However, the valve is positively opened once fluid flow in the bottom chamber from the inlet is reinstituted. Air vent means to the surface and/or to the well annulus rapidly depressurizes the cylinders and hence speeds cycling between the alternate cylinder pairs.

13 Claims, 16 Drawing Figures

FIG. 15
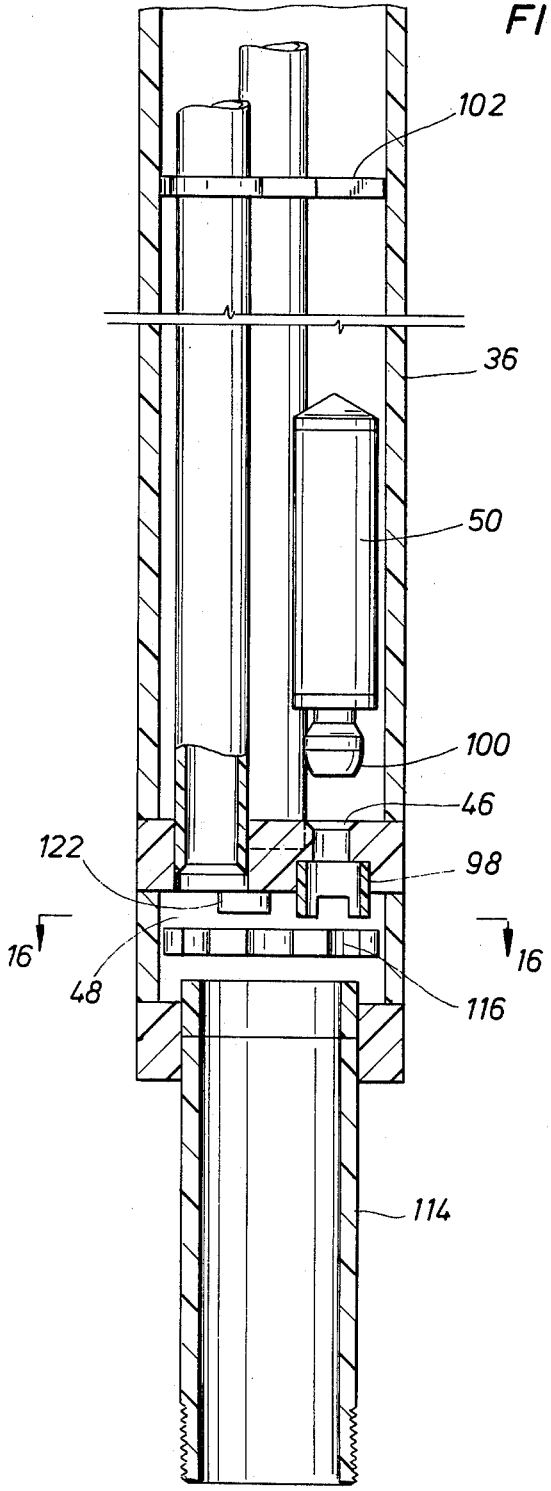
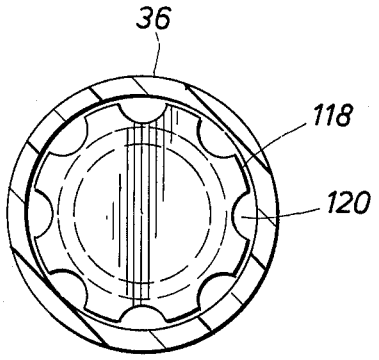
FIG. 16

FLUID LIFTING APPARATUS

BACKGROUND OF THE INVENTION

1. Field of the Invention

This invention relates to fluid pumps, such as might be used in water or oil wells, and more specifically to an air lift pump having a plurality of lift stages and employing a minimum number of moving parts.

2. Description of the Prior Art

Many different systems have been devised for lifting liquid from wells to the earth's surface. These systems have employed various types of pumps, including gas lift pumps, electrically operated centrifugal down hole pumps, sucker rod actuated pumps and so forth. In oil wells, the most common means of pumping the oil to the surface is by the use of a string of sucker rods vertically reciprocated within the well. At the bottom of the string of sucker rods is a pump supported in a string of tubing. The pumping unit at the earth's surface utilizes power, supplied by an engine or motor, to raise and lower the sucker rods and thereby the pump plunger to lift fluid in the tubing from the bottom to the top. In this type of pumping system, which works satisfactorily, a substantial amount of energy imparted to the mechanism is employed in the actuation of the mechanism and only a relatively small percent is utilized in the effort involved to lift the fluid itself.

The present invention is directed towards an improvement in a type of air lift pump in which air pressure is used as the lifting force. The pumping system is arranged such that the fluid is lifted in sequence steps, as opposed to a system for lifting the entire fluid column from the bottom of the well to the top. In the present system, fluid is lifted from one lifting cylinder to the next upper adjacent lifting cylinder. The total head against which the fluid must be lifted is dependent only on the spacing between adjacent lifting cylinders. For instance, the lifting cylinders may be spaced approximately 150 feet apart. The pumping system of this invention is arranged such that the amount of air pressure which is required to lift the fluid from the bottom of the well to the top, regardless of the total depth of the well, is only that which is required to lift the fluid 150 feet. In this way, the amount of energy lost in the pumping process is greatly reduced; the amount of energy utilized in lifting the fluid column is significantly increased.

Prior art systems operating along the same general principles have employed cylinders with flow barrels operating therein, the cylinders being connected directly with their barrels via valving means. Once valves were shut, insidious pressures, such as head pressure, adhesion and the like, thwarted successful operation of the system by preventing reliable sequencing of operation.

Therefore, it is a feature of this invention to provide an improved air lift pump, sequencing between alternate pair of cylinders, each cylinder having a main body and an internal barrel therein, wherein the valving means therebetween includes a positive force for operating the valving means at each cycling.

It is another feature of the present invention to provide an improved air lift pump, sequencing between alternate pairs of cylinders, each cylinder having a main body and an internal barrel therein, wherein the valving means therebetween includes an intermediate chamber for separating the operation of the valving means with respect to the main body and the barrel and for permitting the fluid from the inlet to be applied directly to the valving means, thereby forcing the float off its seat to allow the produced fluid to enter.

It is still another feature of the present invention to provide an improved air lift pump, sequencing between alternate pairs of cylinders, such that operation is not dependent on emptying of one of said pairs of cylinders before sequencing may occur.

It is yet another feature of the present invention to provide an improved air lift pump, wherein well pressures are always less than or equal to the internal pressure of the cylinder production tubing and air lines; thereby preventing collapsing of these components of the system because of the weight of the fluid column.

It is still another feature of the present invention to provide an improved air lift pump system including improved float valves that resist fluid head collapse pressures in excess of those pressures encountered for wells several hundreds of feet deep in which such system is designed for operation.

SUMMARY OF THE INVENTION

A preferred embodiment of the present invention comprises a plurality of elongated lifting cylinders, each cylinder having a main body part, a bottom chamber, a vertical barrel communicating between the chamber and an outlet at the top of the cylinder, and a fluid flow valve in the main body part operating to permit fluid flow to and from the chamber. The chamber is also located to receive fluid flow from the inlet opening to the cylinder. Pressurizing of the cylinder via one of two alternate air lines causes fluid to close a check valve at the inlet and forces the fluid in the main part to flow through the fluid flow valve through the chamber and up the barrel. This opens the check valve and the fluid flow valve of the next higher cylinder. When the alternate air line is activated, the cylinder becomes the receiver of fluid from below, air pressure being quickly vented, preferably through an air vent to the surface or the annulus of the well. Alternate operation of the two air lines causes lifting of fluid quantities from one cylinder to the next higher, until the earth's surface is reached. Should the main part of a cylinder be emptied of fluid, the fluid flow valve seats to prevent air flow in the fluid production tubing portion of the system. New fluid flow at the inlet raises, with positive action, the closure member position of the fluid flow valve from its seat in the passageway to the chamber.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is to be noted, however, that the appended drawings illustrated only typical embodiments of the invention and are therefore not to be considered limiting of its scope, for the invention may admit to other equally effective embodiments.

In the Drawings:

FIG. 15 is a cross-sectional view of a preferred cylinder of the preferred embodiment of the present invention used at the lowermost position.

FIG. 16 is a cross-sectional view taken at section 16—16 of FIG. 15.

DESCRIPTION OF PREFERRED EMBODIMENT

Figures 1, 2:
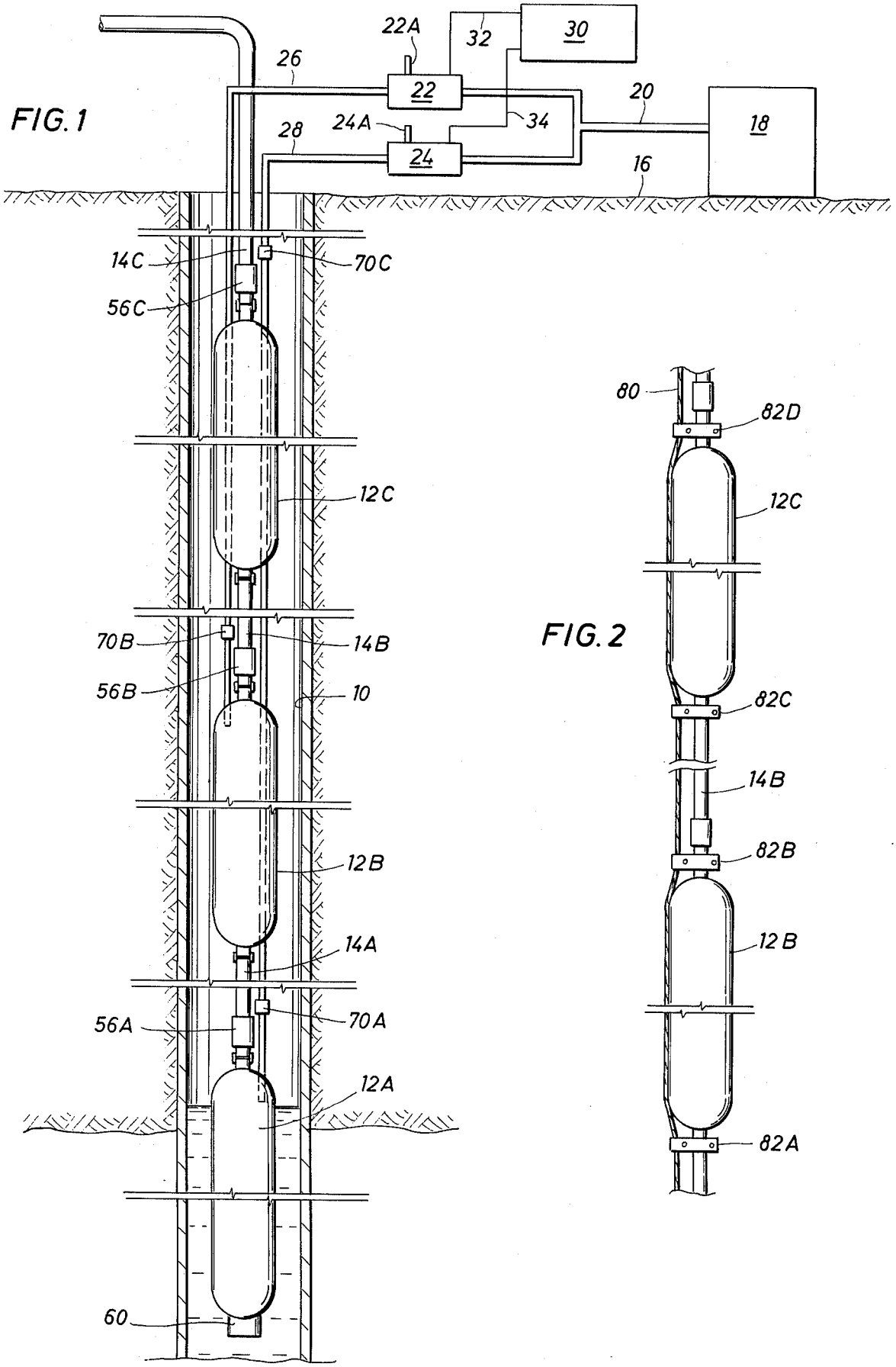
FIG. 1 is a composite view of a casing in a borehole in the earth with the pumping system of this invention mounted therein and with the mechanism utilized for controlling the pumping system at the earth's surface.
FIG. 2 is a partial view of a supporting cable utilized with a first embodiment of the invention illustrated in FIG. 1.

Referring to the drawings and first to FIG. 1, a borehole 10 is shown in the earth's surface 16. Positioned in the borehole 10 is a series of vertically spaced lifting cylinders 12 beginning with the lowermost cylinder 12A. Cylinder 12B is positioned above cylinder 12A and cylinder 12C positioned above cylinder 12B. The drawing illustrates an arrangement wherein only three cylinders are utilized, however, in most applications, particularly if the borehole 10 is deep, a large number of lifting cylinders will be employed. Connecting the lifting cylinders 12 are a plurality of flow tubes 14, together which are sometimes referred to as production tubing. Flow tube 14A connects the upper end of cylinder 12A to the lower end of cylinder 12B; flow tube 14B connects the upper end of the cylinder 12B with the lower end of cylinder 12C; and flow tube 14C connects the upper end of the uppermost lifting cylinder 12C for transportation of the produced fluid to a storage area, pipeline, or the like at the earth's surface 16.

Positioned on the earth's surface is a source of air pressure 18, such as an air compressor, the air from which flows by way of conduit 20 to two control valves 22 or 24. Extending from control valve 22 is a first air line 26 which passes downwardly in borehole 10 and connects to lifting cylinder 12B. When more than three lifting cylinder are employed, the first air line 26 would connect with next-to-last lifting cylinders 12B and to each alternate cylinder thereabove. A second air line 28 extends from valve 24 and connects to lifting cylinder 12C and lowermost cylinder 12A. If more cylinders are used, the second air line 28 would connect with each alternate cylinder spaced above uppermost cylinder 12C.

Air line 28 passes through cylinder 12C and communicates with it through port 29 near its upper end. (See FIG. 3.) Air line 26 passes through cylinder 12C (not shown in FIG. 3) but does not communicate with the interior of the cylinder. In a similar fashion, air line 28 passes through cylinder 12B without communicating with it. FIG. 4 illustrates barrel 40 and air lines 26 and 28 within the main part of cylinder 12C. It may be seen that the air lines may alternately pass to the exterior of cylinders where no communication is required.

Each of the control valves has a vent opening, the vent opening for valve 22 being designated by 22A and the vent for valve 24 being designated by 24A.

A controller 30 is also positioned at the earth's surface and includes a conductor 32 extending to control valve 22 and a conductor 34 extending to control valve 24. Controller 30 is used to switch the valve 22 and 24 alternately at preselected times. When valve 22 is opened, air pressure is applied from source 18 through conduit 20, through valve 22 in first air line 26 into lifting cylinder 12B. At the same time, control valve 24 is actuated such as to vent second air line 28 through vent 24A. After a preselected length of time, controller 30 switches the valves to vent valve 22 and open valve 24 to apply air pressure to the second air line 28A, thereby to lifting cylinders 12A and 12C.

Figure 3:
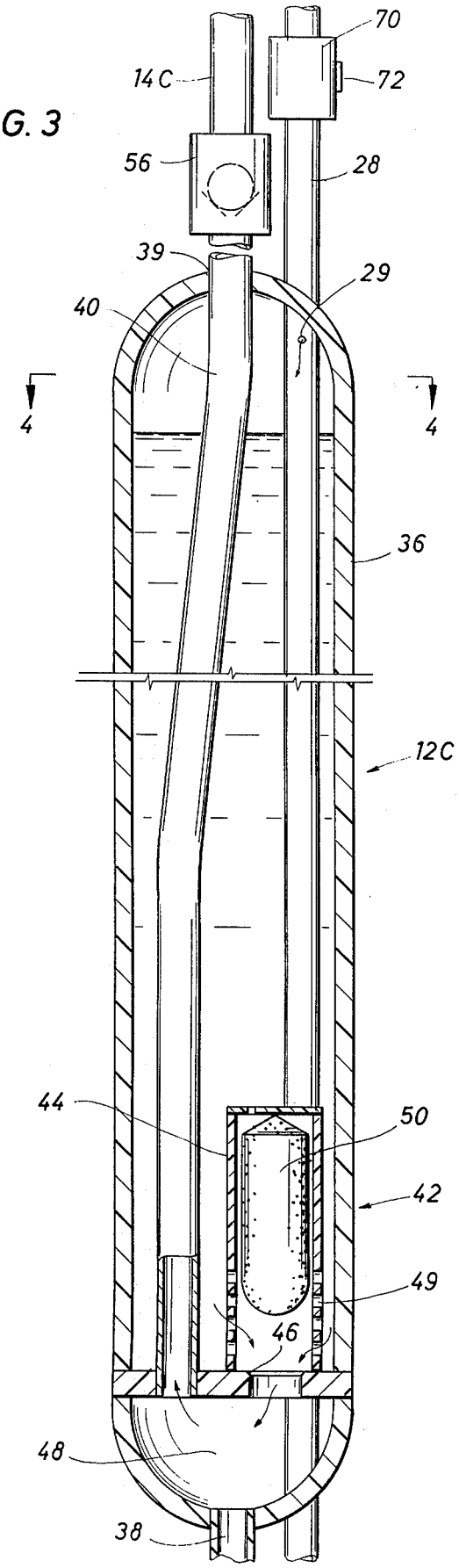
FIG. 3 is a cross-sectional view of a lifting cylinder of the first embodiment in accordance with the present invention.
Figure 4:
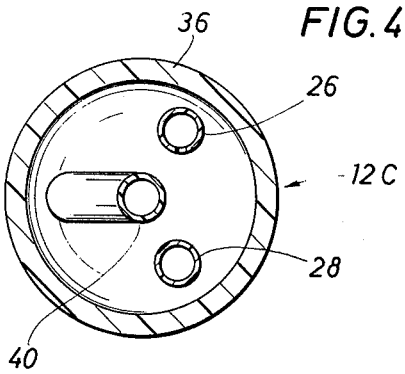
FIG. 4 is a cross-sectional view taken at section 4—4 of FIG. 3.
Figure 5:
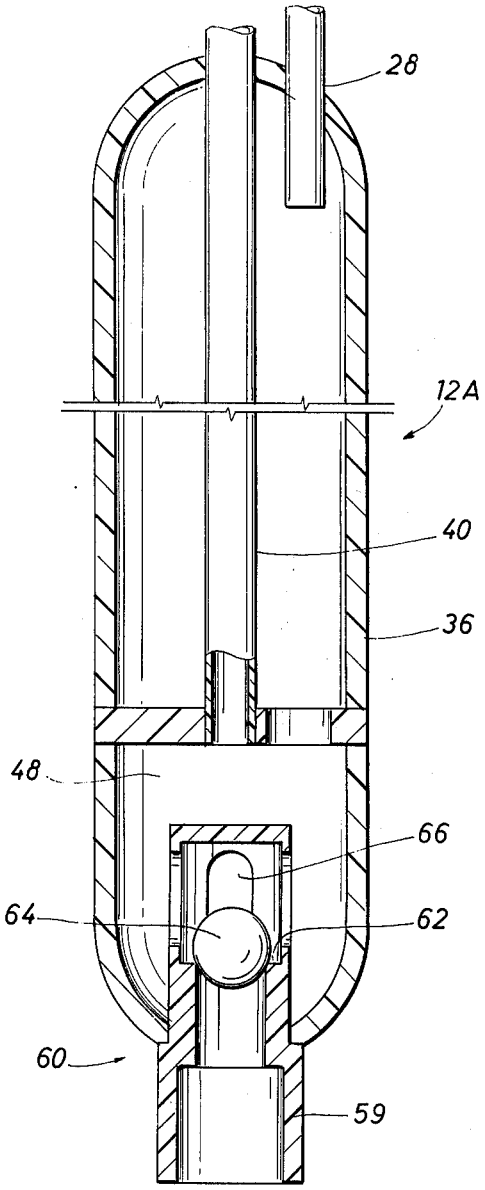
FIG. 5 is a cross-sectional view of a preferred cylinder of the first embodiment of the present invention used at the lowermost position.

Referring to FIG. 3, a cross-sectional view of a typical lifting cylinder of a first embodiment is shown. The arrangement of FIG. 3 is applicable to all the lifting cylinders regardless of the number, except for the bottom cylinder of the first embodiment, which is illustrated in FIG. 5. Cylinder 12C has a cylindrical upright elongated tubular housing 36, preferably formed of plastic, although metal or other material may be used, and has a fluid inlet 38 at the bottom and an outlet opening 39 at the top. The external diameter of the housing 36 must be less than borehole 10. Normally a casing is employed in the borehole with which the pumping apparatus is employed. Housing 36 must be of a diameter to be easily positioned in and removed from the casing in the manner to be described below.

Now referring to FIG. 2, two typical adjacent cylinders 12B and 12C are illustrated with connecting flow tube 14B therebetween. The tubing employed for flow tube 14B and for air lines 26 and 28 are typically made of medium density polyethelyne designed to be substantially inert in oil and gas applications. The wall thickness may be typically on the order of ⅛ inches to 3/16 inches. When the total weight of the pumping apparatus (including primarily the cylinders and the tubing connecting the cylinders) exceeds about 200 pounds, then the tubing begins to elongate. Therefore, for deeper well applications, it is preferable to employ a supporting wireline or cable 80. Cable 80 may be any suitable cable, but a steel multistrand cable has proven the most satisfactory.

Cable clamps 82 conveniently secure cable 80 to flow tubes 14 just below and just above each cylinder 12, cable clamps 82A, 82B, 82C and 82D being illustrated. The configuration of the clamps may be any convenient shape. Typically self-locking screws are provided to permit squeezing the clamps both to the flow tube and to the cables. The clamps are dimensionally less than the radial diameter of the cylinders so that they will not catch on casing joints and the like when the apparatus is lowered or raised in the borehole. Also, such dimensioning causes the cable to fit snugly to the rounded contours of the cylinder to provide maximum support for each separate cylinder.

Now returning to FIG. 3, positioned within housing 36 is a substantially vertical barrel 40, having an external check valve 56 thereabove. The external diameter of barrel 40 fits snugly in outlet opening 39 and is substantially smaller in diameter than the internal diameter of cylinder 36 to permit accommodation of the other various components therein. The upward extension of barrel 40 connects with check valve 56, to be described more fully below.

In the lower portion of the cylinder housing 36 is a valve means generally indicated by the numeral 42. The function of valve 42 is to cause fluid flow up barrel 40 when the fluid level within the cylinder housing 36 indicates it is proper for the cylinder to be emptied and provided the fluid is not below a preselected level.

In this illustrated first embodiment a tubular, upwardly extending valve housing 44 is connected with its lower end in communications with valve seat 46, which, in turn, connects with a fluid passageway to chamber 48 in the bottom of the cylinder. Inlet 38 is connected from below into this same chamber 48. A plurality of perforate, flow-through openings 49 around the lower part of valve housing 44 permit fluid flow to and from the main part of the cylinder and chamber 48 through valve 42.

Slidably positioned in the upper portion of valve housing 44 is valve closure member 50 is of a specific gravity less than that of the fluid to be pumped so that when fluid is introduced into lifting cylinder housing 36 via inlet 38, valve closure member 50 is forced off valve seat 46 and floats upwards leaving the path from chamber 48 to the main part of cylinder 12 open. Sometimes closure member 50 is referred to as the float. When the fluid level drops below a predetermined level, the closure member 50 is lowered so that the seat 46 seals against the seating surface of closure member 50. In this way the fluid level within chamber 48 is always full of fluid and hence the interior of barrel 40 is never exposed to conduit gas from the cylinder.

A check valve is required to close fluid inlet 38 during operation, which is discussed more fully hereinafter. While this may be provided internally of the cylinders, it is convenient to locate the check valve in the flow lines externally of the cylinders and hence in series with such fluid inlet. A check valve 56 is conveniently located in FIG. 3 for this purpose. This valve may be substantially of the same construction as the check valve generally indicated by the numeral 60 in FIG. 5. Check valve housing 59 includes a valve seat 62 into which ball 64 engages by gravity or when there is a downward pressure differential. Openings 66 in housing 59 above seat 62 permit fluid flow through the check valve when ball 64 is pushed off of seat 62.

Check valve 56 is illustrated in FIG. 3 in flow tube 14C as barrel 40 exits the cylinder at outlet 39. However, it may be more appropriate to consider its operation in conjunction with the cylinder located above it than below it.

FIG. 5 illustrates the bottom cylinder, which is a simplified cylinder compared to the cylinder in FIG. 3. It is shown with its own check valve 60 communicating directly with chamber 48. However, there is no need to have a fluid flow valve 42. Chamber 48 still needs an opening to the main part of the cylinder, however.

Alternatively, a cylinder identical to that illustrated in FIG. 3 may be employed as the bottom cylinder, if desired. In such event, a short flow tube 14 having a check valve 56 connected therewith would be attached to inlet 38 of the cylinder.

Each section of air lines 26 and 28 preferably has an air vent valve 70 working in conjunction with the pressurization of a section thereof used for pressurizing a cylinder. This air vent valve is typically located in the air line external to the cylinder in the near vicinity or location to port 29. A preferred air vent valve for this purpose is a Westinghouse air brake dump valve, ⅜-inch iron pipe port size.

Air pressure is vented to the casing annulus through vent valve 70 at appropriate times through opening 72 therein. Alternatively, an air vent valve may be employed in conjunction with every other, or every several cylinders, or even only at the earth's surface for a shallow well installation.

In operation, fluid from the bottom of the well flows through fluid flow valve 60 into chamber 48 of lowermost or bottom cylinder 12A. The purpose of the pump system is to raise this produced fluid to the earth's surfaces, by stages, which is accomplished in a series of steps utilizing air pressure and without moving parts in the pump system itself except for the valve closure members 50, check valve balls 64, and the vent closures of air vent valves 70.

After allowing sufficient time for the lowermost cylinder 12A to be filled by production fluid, which time will depend upon the rate of production of the formation in which the pump is set and which will be learned from experience by the operator, controller 30 provides the proper signal to open control valve 24 for receipt of air pressure from air compressor 18 along line 20 and to vent control valve 22 and all air vent valves located in air line 26, such as vent 70B. This applies air pressure by way of second air line 28 to the cylinders connected thereto to which line 28 is ported therewith. The air pressure enters the housing of lowermost lifting cylinder 12A, closing check valve 60, forcing fluid therein to pass upwardly through barrel 40. The fluid is forced upwardly through the barrel through check valves 56A and flow tube 14A and into the interior of cylinder 12B. At the same time, air pressure is applied to the interior of cylinder 12C. Any fluid therein will be forced upwardly through flow tube 14C for storage, transportation or whatever. However, if there is no fluid in cylinder 12C, valve 42 therein will remain closed so that air pressure cannot flow into chamber 48 and barrel 40.

The length of time the air pressure must be applied to second air line 28 will depend upon the viscosity of the fluid, the diameter and length of the cylinders, the diameters of tubes 14 and so forth, but such will be learned immediately by experience of the operator. When each cylinder being pressurized is emptied of fluid, valve closure member 50 closes against seat 46 to prevent the flow of air upwardly into chambers 48, barrels 40 and flow tubes 14. However, as will be explained, it is not necessary for the cylinders to completely empty before the alternate cycling of the air lines, to accomplish the stage lifting. Of course, rapid cycling would mean that only a little fluid would be raised with each cycling sequence. In such event, closure member 50 would not seat, but this would not have an effect on the otherwise successful operation of the pump.

The amount of air pressure required depends upon the spacing between cylinders, that is, if the cylinders are spaced at a longer vertical distance relative to each other, more air pressure must be applied to lift the fluid each step. With shorter vertical spacings, less pressure is required. Therefore, the spacings will depend to a degree on the type of materials utilized. If the components of the pump system are made of plastic having a lower pressure resisting capability, the cylinders will be placed closer together, whereas if the components are made of metal the cylinders may be placed further apart.

Should the fluid in cylinders 12A and 12C have been emptied so that valve closure members therein are closed, no further fluid or air would be passed upward through barrels 40, even though pressure is applied. Not only does pressure and gravity cause closing of members 50, but the venturi effect causes a hard closing and sealing to occur. When controller 30 is actuated to switch control valve 24 to the vent position and control valve 22 to the open position, air pressure is applied to first line 26 and removed from second line 28. In such event, cylinder 12A is pressure relieved, thereby causing check valve 56A thereabove and below cylinder 12B to close. Since there is a body of fluid in the main part of cylinder 12C this fluid flows through the perforate openings 49 into housing 44 of fluid flow valve 42, underneath closure member 50, and through the passageway to chamber 48. (See the illustrated direction arrows.) Because of the air pressure in the cylinder, fluid is forced upwards through barrel 40, through check valve 56B above cylinder 12B, thereby forcing closure member 50 up off seat 46, through valve 42 and into cylinder 12C. This is true even through the closure member is seated, there being no opposing head pressure applied thereto. Normal adhesion will also not be a problem with the application of this positive pressure from below.

Note also that fluid cannot be forced appreciably up barrel 40 in cylinder 12C at this time since the check valve thereabove is closed to cause an ever-increasing opposing pressure to the upward flow of fluid.

By alternate timed switching of air pressure from first air line 26 to second air line 28 and back, fluid is lifted in sequential steps from alternate cylinders to the next adjacent upper cylinders. The maximum air pressure required is that determined by the hydrostatic head between adjacent cylinders, which is determined by the specific gravity of the fluid being pumped and the vertical spacing between cylinders. Normal operating air pressure is in the approximate range of 90–125 pounds per square inch.

It may be seen that in the event switching of air occurs before the fluid descends to the level to permit seating of closure 50 in a particular cylinder, operation of the pump is not affected.

While the invention has been described using air as the medium for forcing fluid from the bottom of a borehole to the earth's surface, the word "air" means any gas or other medium lighter than and immiscible with the liquid being pumped.

In a operating system in accordance with the embodiment of the invention described above, cylinders from 6 to 10 feet long and 3½ inches in diameter have been employed. The air lines have been employed which were each ½ inch pipe size in diameter and the flow tube dimension was from ¾ inch to 1 inch iron pipe size in diameter.

Cylinders are typically spaced 100–200 feet apart and require only about 100 psi of air pressure for activation. The closer the spacing the less pressure is required. Hence, one small inexpensive air compressor may be used to operate several satellite walls. Cycling between air lines depends on how rapidly fluid fills the well. However, roughly speaking, cycling is typically on one to three minute intervals to produce between 30 and 10 barrels per day of fluid. Stripper wells approximately 1500 feet deep operating at about 20 barrels per day are ideal for operating with the system just described.

For an 1800-foot well, the apparatus just described weighs about 2,000 pounds. A cable to support that load safely would be used for cable 80.

A 3M glass-bubble material comprising bubbles adhered together with epoxy, each bubble having an approximately outside diameter of 0.0001 inch and an average density of 0.5, has been employed for closure member 50.

Now referring to FIGS. 6–16, a second and preferred embodiment of the present invention is illustrated. Like components of this embodiment are numbered in accordance with the same numbering scheme employed above with respect to the first embodiment.

Figure 6:
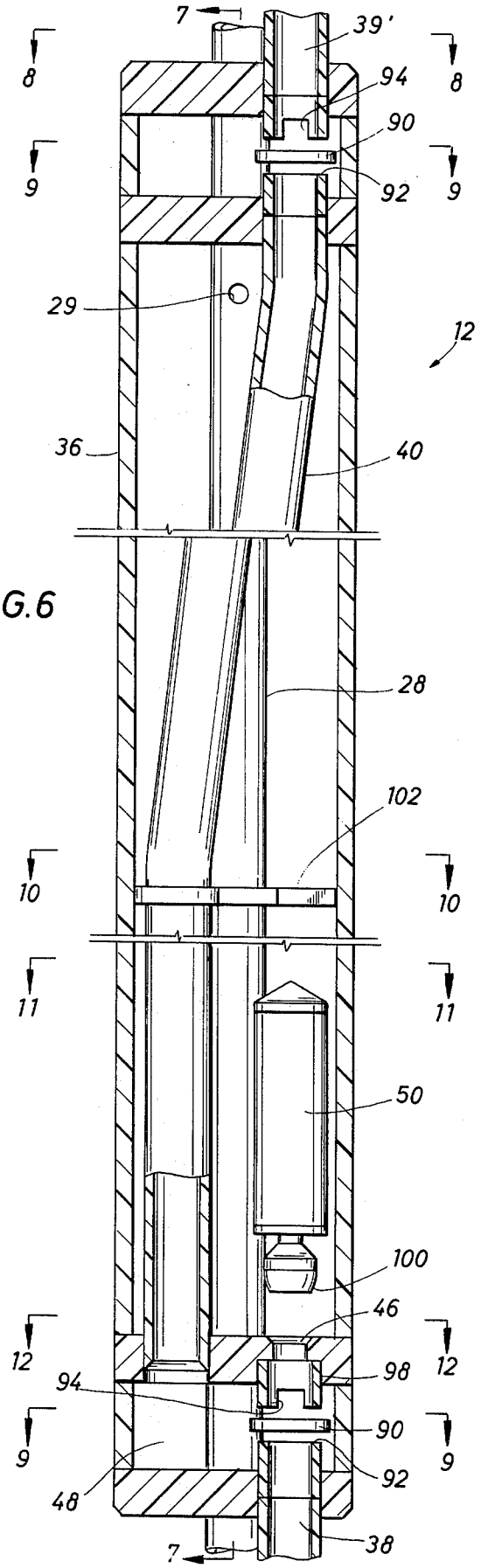
FIG. 6 is a cross-sectional view of a lifting cylinder of a preferred embodiment in accordance with the present invention.

In this embodiment, all of lifting cylinders 12, except for the bottom cylinder, is typified by the cylinder illustrated in FIG. 6. The bottom cylinder of this embodiment is shown in FIG. 15. Cylinder 12 has a cylindrical upright elongated tubular housing 36, preferably formed of plastic, and has a fluid inlet 38 at the bottom and an outlet opening 39' at the top. In this embodiment check valve operation is internal to the cylinder structure, rather than external as with check valve 56 in the first embodiment. Therefore, outlet opening 39' is located above check valve disc 90. Flow tube connections and cable connections are identical as with the first embodiment.

Positioned within housing 36 is a substantially vertical barrel 40 having a smooth horizontal top surface 92 against which check valve disc 90 seals. The lower end of outlet opening 39' to the production tubing is concentric with top surface 92 and spaced apart therefrom to permit disc 90 to raise off the surface 92. However, the end includes notch 94 to permit fluid flow around disc 90 when it raises off surface 92. As may be best seen in FIG. 9, the lateral clearance of disc 90 with respect to air lines 26 and 28 and with respect to the cylinder wall at clearance 96 prevents disc 90 from lateral migration away from end surface 92.

In the lower portion of cylinder housing 36 is a valve means generally indicated by the numeral 42. Note that in this embodiment, there is no valve housing, as with the first embodiment. There is a fluid passageway 98 from chambers 48 in the bottom of the cylinder to the main part of the cylinder. The passageway terminates at its upper end in valve seat 46 and at its lower end in a surface having at least one notch 94. Inlet 38 is connected from below into chamber 48 and is aligned with, but spaced apart from, the passageway to permit the operation of another check valve disc 90 within chamber 48 in the same manner as described above. For the same reason top end 92 of inlet 38 is a smooth horizontal surface.

Figure 11:
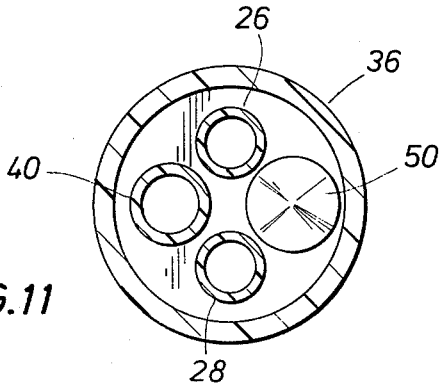
FIG. 11 is a cross-sectional view taken at section 11—11 of FIG. 6.

Closure member 50 is of a specific gravity less than that of the fluid to be pumped so that when fluid is introduced into lifting cylinder housing 36 via inlet 38, valve closure member 50 is forced off valve seat 46 and floats upwards leaving the path from chamber 48 to the main part of cylinder 12 open. The bottom of closure member 50 terminates in a ball 100. When the fluid level drops below a predetermined level as determined by the length and buoyancy of closure member 50, member 50 is lowered so that seat 46 seals against ball 100. As best shown in FIG. 11, the lateral movement of member 50 is restricted by air lines 26 and 28 and the wall of cylinder 36. Even if the member does not descend perfectly vertical, the surface of ball 100 ensures a satisfactory seal with seat 46.

Figure 10:
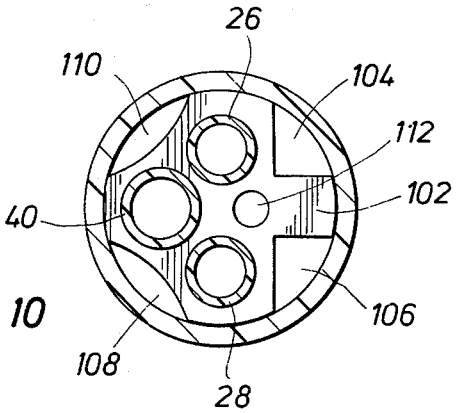
FIG. 10 is a cross-sectional view taken at section 10—10 of FIG. 6.

One other structure within the cylinder is significant. This is spacer 14, as is best illustrated in FIG. 10. Spacer 102 includes openings through which air lines 26 and 28 and barrel 40 are passed for locating these components in the approximate midpoint of the cylinder. Spacer 102 also includes a wing located over closure member 50 to arrest the upward movement thereof. Openings 104, 106, 108, 110 and center opening 112 permit free flow of fluid within the cylinder past the spacer.

FIG. 10 illustrates the bottom cylinder, which is a simplified version of the cylinder shown in FIG. 6. As illustrated a pipe section 114 forms the lower inlet, this section typically having a 2-inch diameter and terminating in suitable external threads onto which a mud anchor may be secured. In lieu of a small check disc, a large disc 116 is located for operating within chamber 48, disc 116 having just enough clearance 118 at its outer periphery to permit easy up and down movement with an applied pressure differential. The outer edge is fluted to form passageways 120 around disc 116 when it raises off the end of pipe section 114. In its lowermost position, disc 116 seals against the smooth horizontal end of section 114. Passageway 98 depends slightly into chamber 48 to one side of the center of the cylinder. One or more spacers 122 are positioned about the center in complementary fashion with passageway 98 to prevent disc 116 from becoming skewed in chamber 48 and wedging therein so that it would not lower during operation.

Figure 7:
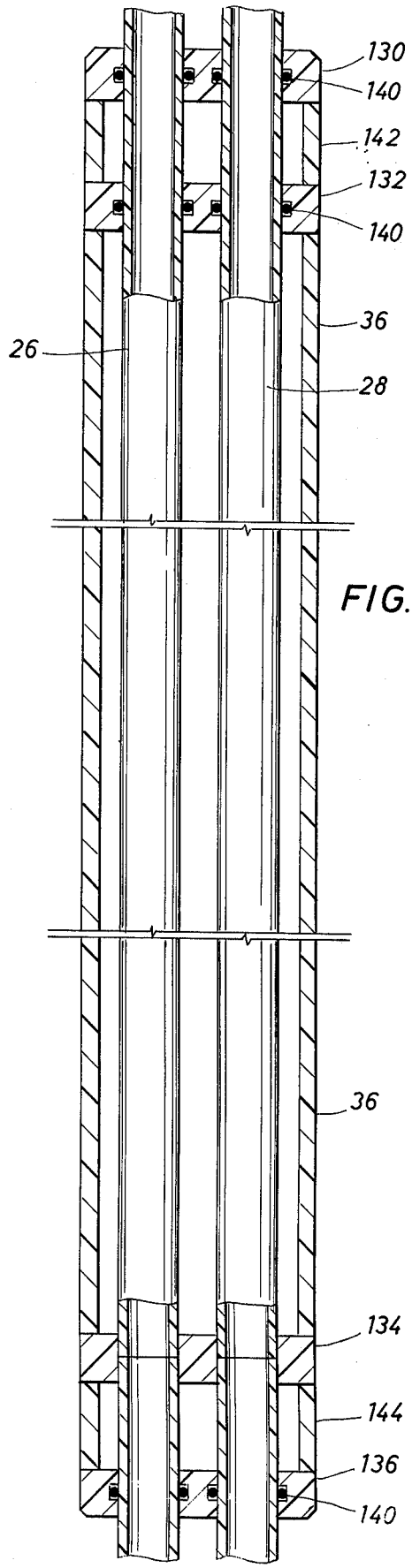
FIG. 7 is a partial cross-sectional view of the cylinder shown in FIG. 6 illustrating a preferred method of assembly thereof with respect to the air lines.
Figure 8:
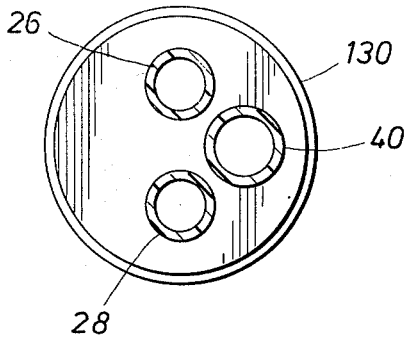
FIG. 8 is a cross-sectional view taken at section 8—8 of FIG. 6.
Figure 12:
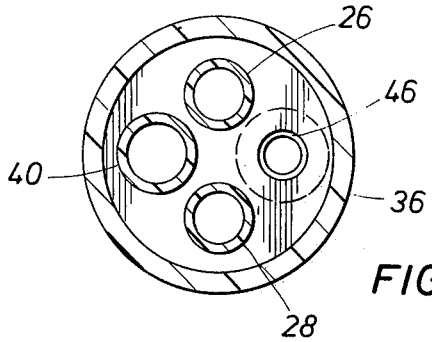
FIG. 12 is a cross-sectional view taken at section 12—12 of FIG. 6.
Figure 9:
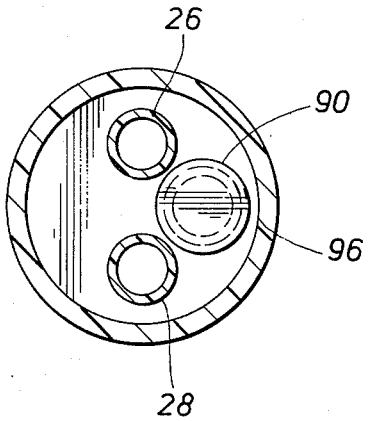
FIG. 9 is a cross-sectional view taken at section 9—-9of FIG. 6.

Now referring to FIG. 7, a convenient method of assembling the cylinder illustrated in FIG. 6 is shown with respect to air lines 26 and 28. Plastic puck-like sections 130, 132, 134 and 136 are made to receive air lines 26 and 28 through openings therein all but puck 134 includes O-rings 140 to permit movement of the tubes therein while maintaining a fluid-tight seal thereagainst. With puck 134 heat sealed or fused in place on cylinder 36, pucks 132, intervening wall section 142 and puck 130 are progressively heat sealed into place. Bottom intervening wall section 144 and puck 140 are then sealed in place. Note that the air vent sections are also sealed to each other during this last operation.

Figure 13:
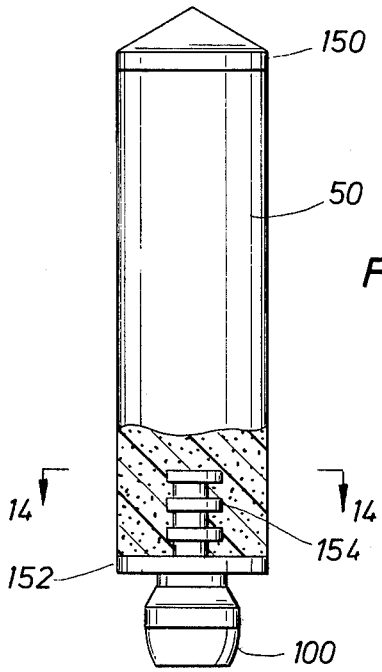
FIG. 13 is a partial cross-sectional view of a preferred embodiment of a closure valve member in accordance with the embodiment of the invention illustrated in FIG. 6.
Figure 14:
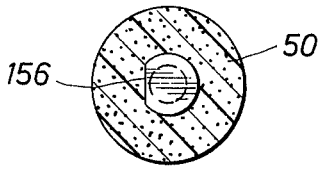
FIG. 14 is a cross-sectional view taken at section 14—14 of FIG. 13.

Now referring to FIGS. 13 and 14, closure member 50 is illustrated in detail. As may be recalled, the main portion of this member is comprised of glass bubbles (of approximately 0.001 inch diameter) and epoxy, which is not particularly wear resistant against abrasion. Therefore, polyethylene bearings 150 and 152 are included near the top and bottom to minimize abrasive wear during operation.

A unified piece forming ball 100 and having locking surfaces 154 projects upwards into the body of closure. These surfaces include flat side 156, as illustrated in FIG. 14, to prevent this unified piece from turning.

Operations of the embodiment shown in FIGS. 6–16 is essentially the same as with the first embodiment except that closure member 50 does not operate within a valve housing and there is a simplified check valve structure. The advantage of eliminating the valve housing is that there is no danger of foreign matter becoming stuck therein to interfere with easy operation of the movable closure member. The simplified check valve structure makes each cylinder autonomous without excessive structures. This simplifies manufacture and repair.

While a particular embodiment of the invention has been shown, and described, it will be understood that the invention is not limited thereto, since many modifications may be made and will become apparent to those skilled in the art.

What is claimed is:

1. Apparatus for lifting fluid from the bottom of a well in stages to the earth's surface, comprising:

a plurality of vertically spaced lifting cylinders, each of said cylinders having a fluid inlet and a fluid outlet, a plurality of flow tubes, one each being connected between the inlet and outlet of adjacent cylinders, said flow tubes and cylinders providing a closed conduit for the flow of fluid from the well bottom to the earth's surface, a plurality of check valves, one of said check valves being in series with each of said fluid inlets, a plurality of vertical barrels, one barrel positioned within each of said cylinders of external diameter less than the internal diameter of said cylinder, each barrel communicating at its upper end to the cylinder fluid outlet and at its lower end with a bottom chamber communicating with the cylinder fluid inlet, a first air line extending from the earth's surface and ported into the bottom cylinder and each alternate cylinder thereabove, a second air line extending from the earth's surface and ported into the next-to-bottom cylinder and each alternate cylinder thereabove, means for alternatively applying air pressure to said first and second air lines, each of said air lines being vented while the other of said air lines is being pressured, and a plurality of valve means for determining the fluid flow from said cylinders, one of said fluid flow valve means being in each of said cylinders communicating with said bottom chamber therein, each of said fluid flow valve means having a float therein for closing said valve when the fluid in the cylinder is below a predetermined level, whereby fluid in each of said cylinders ported to the one of said air lines being pressured is pressured downwardly through its fluid flow valve means into the bottom chamber to close the check valve in series with the fluid inlet and to flow upwards through said chamber and said barrel to the next adjacent cylinder thereabove, to positively open the check valve to said next adjacent cylinder and said fluid flow valve means therein to permit filling said next adjacent cylinder with fluid.

2. Fluid lifting apparatus as described in claim 1, wherein each of said valve means includes a perforated housing surrounding said float.

3. Fluid lifting apparatus as described in claim 1, wherein said air lines extend vertically through said cylinders, the lateral movement of said float in each of said cylinders being restricted by contact with said air lines.

4. Fluid lifting apparatus as described in claim 3, wherein the upward movement of said float is restricted by a spacer within said cylinder, said spacer enclosing at least one of said air lines and having openings therein for easy circulation of fluids within said cylinder.

5. Fluid lifting apparatus as described in claim 1, wherein at least one of check valves includes a ball and valve seat.

6. Fluid lifting apparatus as described in claim 1, wherein at least one of said check valves includes a disc and flat surface.

7. Fluid lifting apparatus as described in claim 6, wherein air lines extend vertically through said cylinders, the lateral movement of said disc being restricted by contact with said air lines.

8. Fluid lifting apparatus as described in claim 1, and including at least one air vent means in each of said air lines for respectively venting said second and first lines to the annulus of the well when said first and second lines are alternately, respectively pressurized.

9. Fluid lifting apparatus as described in claim 1, wherein said float is a glass bubble material having a density of approximately 0.5 and having strength to resist the pressure in a well having a head of 3,000 feet.

10. Fluid lifting apparatus as described in claim 1, and including a support cable therefor and a plurality of clamping means for securing said cable to a plurality of flow tubes, said clamps not extending beyond the lateral limits of said cylinders.

11. The subcombination of a lifting cylinder for use in an apparatus employing a plurality of such cylinders in air lifting fluid sequentially from one cylinder to the next, said cylinder comprising:

a cylindrical shaped body having an inlet at the bottom and an outlet at the top, a lateral wall within said cylinder forming a chamber in communicating with said inlet and having a passageway to a valve seat in the main part of said cylinder, a vertical barrel within the main part of said cylinder communicating with said chamber and with said outlet, valving means including a float operating with said valve seat, said float closing with said valve seat when the fluid in that main part descends to a predetermined level, said float being driven from said seat with upward fluid flow from said chamber, and at least an opening in said main part of said cylinder for receiving an air line thereto.

12. The subcombination as described in claim 11, wherein said float including a ball at its lower end for operating with said valve seat.

13. The subcombination as described in claim 11, and including air lines extending vertically through said cylinder, the lateral movement of said float being restricted by contact with said air lines.

* * * * *